United States Patent [19]

Hardway et al.

[11] 4,347,509

[45] Aug. 31, 1982

[54] PLASMA DISPLAY WITH DIRECT TRANSFORMER DRIVE APPARATUS

[75] Inventors: Jay B. Hardway; Larry W. Eichman, both of Cambridge, Ohio

[73] Assignee: NCR Corporation, Dayton, Ohio

[21] Appl. No.: 125,070

[22] Filed: Feb. 27, 1980

[51] Int. Cl.[3] ..... G09G 3/28

[52] U.S. Cl. ..... 340/778; 340/811; 315/169.4

[58] Field of Search ..... 340/778, 777, 776, 771, 340/811; 315/169.4

[56] References Cited

U.S. PATENT DOCUMENTS

| | | | |
|---|---|---|---|
| 3,588,597 | 6/1971 | Murley, Jr. | 340/778 |
| 3,609,746 | 9/1971 | Trogdon | 340/778 |
| 3,665,455 | 5/1972 | Schmersal et al. | 340/778 |
| 3,973,253 | 8/1976 | Criscimagna et al. | 340/778 |
| 4,079,290 | 3/1978 | Trushell | 340/778 |

*Primary Examiner*—Marshall M. Curtis

*Attorney, Agent, or Firm*—J. T. Cavender; Wilbert Hawk, Jr.; Richard W. Lavin

[57] ABSTRACT

A system for driving a plasma display panel is disclosed in which a transformer operated at a system clock frequency supplies voltage pulses to both the electrodes in the cells of the display device. Switching members operated by control signals generated by a control member select the cells to be discharged. A circuit for regulating the transformer output voltage in accordance with the number of cells discharged is also disclosed.

11 Claims, 13 Drawing Figures

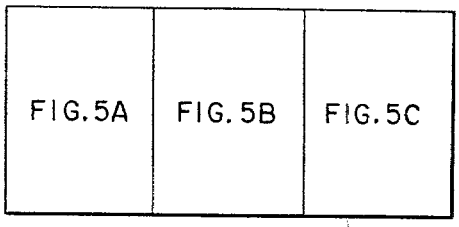
FIG. 6
FIG. 5A
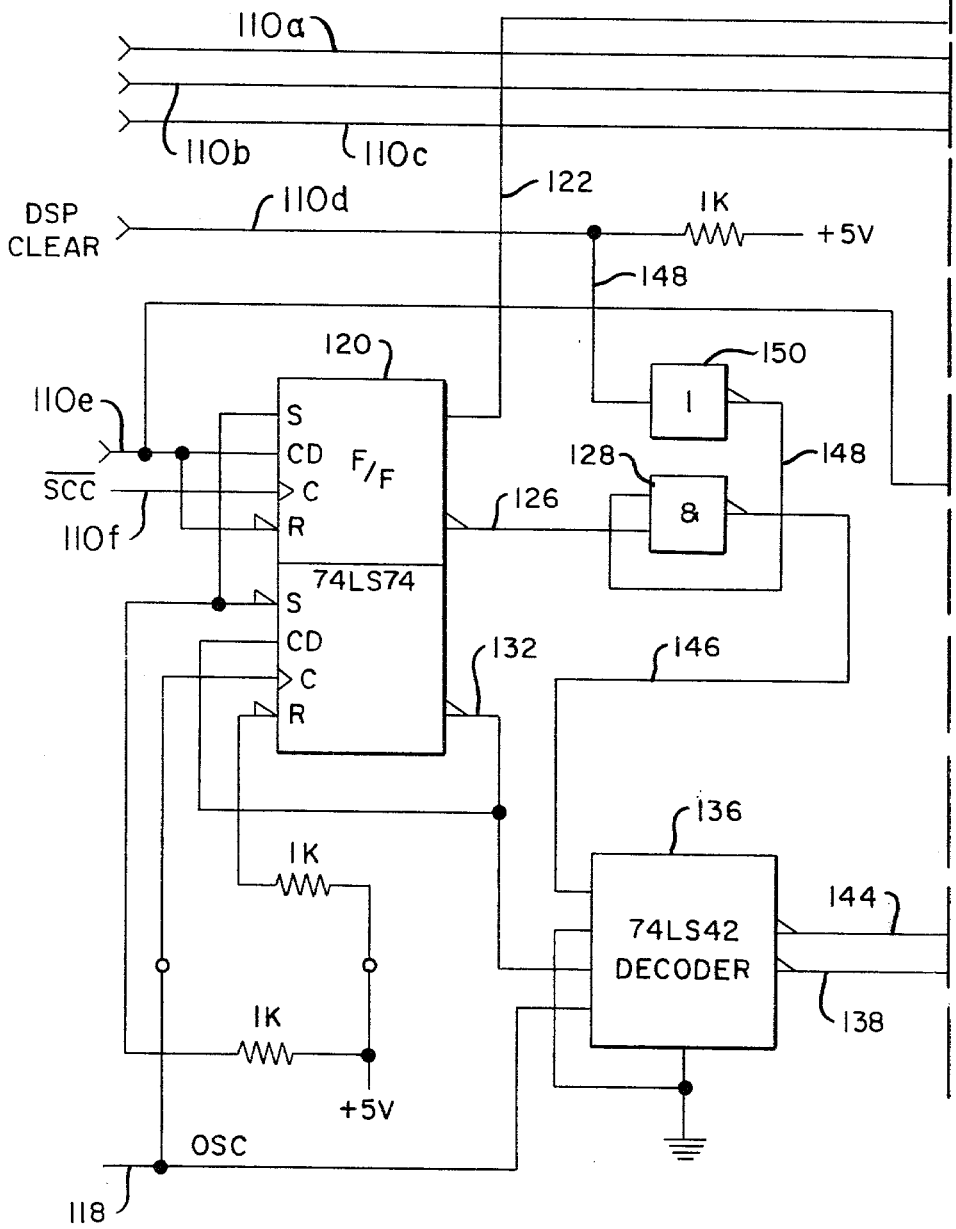

PLASMA DISPLAY WITH DIRECT TRANSFORMER DRIVE APPARATUS

BACKGROUND OF THE INVENTION

The present invention is directed to an A.C. coupled gas-discharge display device of the multi-digit or character indicator type and more particularly to a drive circuit for driving such a display related to multiplexed operation of such display devices to provide an improved operation of the display device.

It is well-known that an electroluminescent cell can be interposed between first and second electrodes and that, upon the application of a suitable electric potential between the first and second electrodes connected to the cell, the cell will become luminescent because of the ionization which occurs within the cell. This characteristic lends itself quite readily for use in a display panel. A control circuit for driving such display is shown in U.S. Pat. No. 3,614,769, which issued Oct. 19, 1971 on the application of William E. Coleman et al. and assigned to the assignee of the present invention.

As disclosed in the Coleman et al. patent, the application of an electric field to an electroluminescent cell causes ionization to occur within the cell. The electric field imparts energy to electrons which collide with other atoms, thus releasing other electrons. This electron multiplication process continues until breakdown occurs, at which time ignition occurs, that is, a gaseous discharge occurs within the cell, causing positive charges to be deposited on the cell walls connected to the cathode and electrons to be deposited on the cell walls connected to the anode. The charges deposited on the cell walls are trapped because of the capacitive coupling effect exerted by the cell walls. Since positive ions are attached to the cathode wall and electrons are attached to the anode wall, the wall charge will be of a polarity opposite to that of the electric field which instigated the gas discharge. In other words, the voltage contributed by the wall charge will be opposite in polarity to the applied electric field. Thus, it can be seen that after discharge occurs, the total voltage impressed on the cell will be the algebraic sums of the voltages applied to the cell terminals plus the voltage contributed by the wall charge, which after ignition is negative with respect to the applied voltage, therefore resulting in a decreased cell voltage.

The gas discharge which occurs in the cell continues until the wall voltage builds up to a certain value. This value is given by the relationship $V_A - V_W < V_E$, where $V_A$ is the applied voltage, $V_W$ is the wall voltage, and $V_E$ is the voltage below which the cell is extinguished. In order to energize the cell again using the same magnitude of applied voltages, it is necessary to reverse the polarity of the applied voltages to the cell, thereby impressing an applied voltage across the cell which is adequate with the wall voltage left from the previous discharge, thus permitting a gas discharge to occur in the reverse direction. Since the wall charge is trapped within the cell, the wall voltage will always oppose the voltage which initiated the gas discharge.

Information is visually displayed in the display device in the form of characters, the characters being formed by a group of electroluminescent cells or segments containing an encapsulated gas. The illumination is provided by a gaseous discharge within the cell which occurs upon the application of an electric field at the cell terminals, thereby igniting the cells. Control circuits are provided for selectively energizing the electroluminescent cells, each of which is capacitively coupled between two electrodes, such as a segment electrode and a column electrode. The number of segment electrodes is determined by the number of cells per character, and the number of column electrodes is determined by the number of characters in the display device. Electrically, this takes the form of a matrix in which the columns are called column electrodes. Each individual cell connected in a column is called a segment cell, and the segment cells in each row are connected to a character column electrode. One end of each segment electrode and each column electrode is connected to a potential source through appropriate drive transistors. The other ends of the segment and column electrodes are each connected to ground through individual drive transistors. The energization of selected segment cells in addition to the energization of a particular column electrode determines the character to be displayed. Circuit means are provided for logically controlling the drive transistors.

In order to illuminate a selected cell for display purposes, it is necessary to alternately energize the electrodes connected to the selected cells. In a multiplexing operation of each character, the column electrodes in each of the characters is connected to a common driver together with a selected number of segment cells connected to a common segment driver. During a multiplexing operation, the display's control logic uses both the common column and segment drivers to designate which cells are to be energized. This operation occurs on a scanned "one column at a time" basis. A blanking period is required between the selection of the columns to enable the segment data to be transmitted to the control logic. Because of the large voltages involved to drive currently available displays, circuits supplying these high voltage pulses are required which have been very costly thereby increasing the cost of the displays.

Various methods have been set forth to improve the operation of plasma displays. In the patent to Johnson et al., U.S. Pat. No. 3,513,327, which issued on May 19, 1970, there is included the use of transformers in the driver circuits in which the secondary windings of the transformers supply the voltage to one of the elements of the display upon the application of an energizing pulse. The circuitry for controlling the operation of each of the transformers in the Johnson et al. reference is very complicated and therefore costly which, together with the cost of each of the transformers, limits the attractiveness of such a driver circuit. A similar drive circuit is found in the U.S. Pat. No. 4,110,663, issued to Mizazaki et al. on Aug. 29, 1978.

It is therefore the principal object of the present invention to provide a gas display device which is lower in cost than those of the prior art. It is a further object of this invention to provide a low cost drive circuit for a gas display device utilizing low power, low voltage integrated circuit drivers. It is another object of this invention to provide a low cost gas display device having a minimum number of circuit elements and substantially fewer than display devices presently available.

SUMMARY OF THE INVENTION

These and other objects of the invention are fulfilled by providing driver circuits for the electroluminescent cells which include a DC driven flyback transformer coupled in series with the column and segment driver transistors for supplying at a frequency rate equal to the system clock, the total voltage for the column and segment electrodes required to fire the cells of the display. Applying a DC voltage to the primary winding of the transformer and disabling the DC voltage prior to the time of firing the cells enables the secondary winding of the transformer to provide a pulsating voltage output which provides the total voltage required to fire the display. This construction allows the voltage required to be applied by the individual driver transistors in firing the cells to be low, enabling lower voltage transistors to be employed in the driver circuits thereby lowering the cost of the driver circuit. Out of phase clock signals operate both the transformer and the driver transistors to provide the required voltage level at selected cells to fire the cells. The DC voltage applied to the primary windings of the transformer is regulated in accordance with the number of cells being fired.

BRIEF DESCRIPTION OF THE DRAWINGS

FIGS. 5A, 5B and 5C taken together are a schematic diagram of the converter drive portion of the display driver circuits for energizing the column electrode in a cell in accordance with the present invention;

FIG. 6 is a diagram showing the manner in which FIGS. 5A–5C inclusive are arranged with respect to each other to form the driver circuits;

FIG. 8 is a diagram showing the manner in which FIGS. 7A and 7B inclusive are arranged with respect to each other to form the driver circuit;

DESCRIPTION OF THE PREFERRED EMBODIMENT

Figure 1:
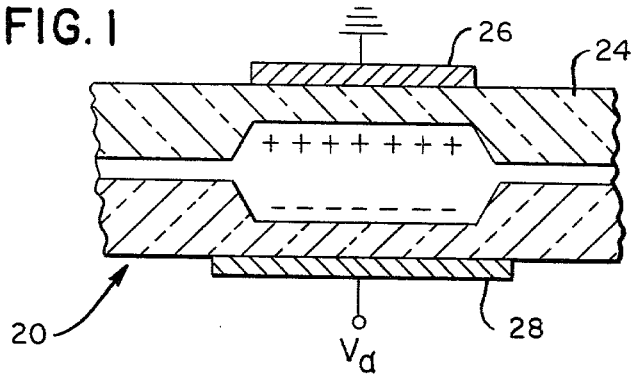
FIG. 1 is a sectional view of a gas-discharge cell that can be utilized with the present invention.

FIG. 1 is a representation of an electroluminescent display cell which may be used with the present invention. The cell generally indicated by the numeral 20 usually comprises a glass sandwich 24 encapsulating a gas at a particular pressure. A discharge which occurs in the encapsulated gas and provides sufficient illumination for use in visual displays will occur within the cell 20 upon the application of a particular potential $V_a$ between the electrodes 26 and 28, the electrodes being located externally of the cell in order to utilize its capacitive properties. The electrons and ions created by the discharge will attach to the anode and cathode sides of the glass cell, respectively, to produce what is commonly referred to as a wall charge. The voltage $V_W$ attributed to the wall charge has a polarity opposite to that of the applied voltage $V_a$ which initiated a discharge. Upon reversal of the applied voltage $V_a$, the voltages $V_a$ and $V_W$ will be additive, thereby causing another discharge to occur and permitting the use of a voltage $V_a$ which can be at a lower level than that which originally initiated a discharge.

Figure 2:
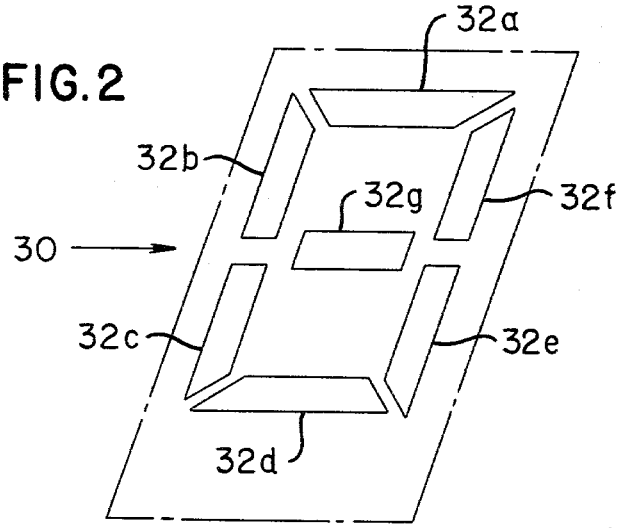
FIG. 2 is a plan view of a representative character display.

FIG. 2 shows a plurality of cells of the type illustrated in FIG. 1 combined to form a conventional 7-bar code matrix 30 comprising seven individual segments or cells **32*a*–32*g*** inclusive. Individual ones of these segments can be selectively energized to form desired numerical characters. A similar matrix of fourteen individual segments are arranged in a manner that is well-known in the art to form characters of the alpha code.

Figure 3:
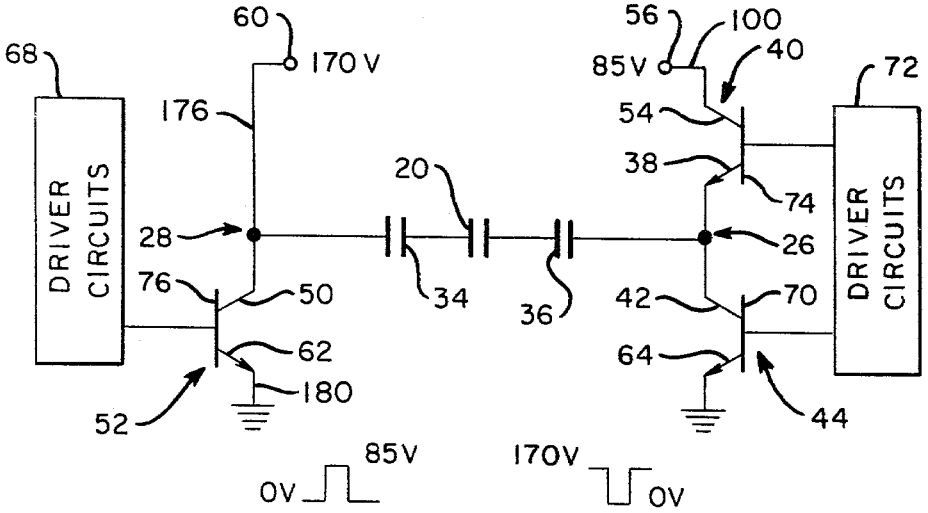
FIG. 3 is a schematic diagram of a representative gas display cell.

The electroluminescent cell 20 of FIG. 1 is diagrammatically illustrated in FIG. 3 as being capacitively coupled to the cell electrodes 26 and 28, in which at least one of the electrodes is transparent for the passage of light. Although two coupling capacitances 34 and 36 are illustrated because of the glass dielectric between each exterior electrode and the adjacent interior glass wall surface, one of such coupling capacitors could be eliminated and the combination would still be referred to as a capacitively coupled cell.

The electroluminescent cell electrode 26 (FIG. 3) representing one of the segments **32*a*–32*g* inclusive (FIG. 2) is coupled to the emitter 38 of an NPN transistor 40 and the collector 42 of an NPN transistor 44. The electroluminescent cell electrode 28 representing a column electrode is coupled over a column conductor 176 to a 170 volt A.C. voltage source 60 and the collector 50 of an NPN transistor 52. The collector 54 of the transistor 40 is connected over a segment conductor 100 to a voltage source 56 of 85 volts D.C. The emitters 62 and 64 of the transistors 52 and 44** respectively are connected to ground.

The base 76 of transistor 52 connects with driver circuits 68 while the base 70 of transistor 44 is connected with driver circuits 72. As will be explained in more detail hereinafter, the transistor 44 is switched to a conducting state by signals transmitted from the driver circuits 72, thereby impressing 170 volts across the cell electrodes 26 and 28. The voltage necessary to ignite the cell 20 is somewhere between 200 and 260 volts, which is attained when the 170 volts appearing on the column electrode 28 is combined with the 85 volts appearing on the segment electrode 26. After the voltage appearing at the electrode 28 has risen to a level of 170 volts, the transistor 44 is switched into a nonconducting state by the driver signals received from the driver circuits 72 and the transistors 40 and 52 are driven into a conducting state by signals transmitted from the driver circuits 68 and 72. This switching action results in the removal of the 170 volts through the transistor 52 and 85 volts being impressed on the electrodes 26 and 28 of the selected cells 20 by means of a current path which extends from the emitter-collector path of the transistor 40, through the cell 20 with the coupling capacitors 34 and 36 and through the collector-emitter path of the conducting transistor 52 to ground.

The impressing of the 85 volts on the selected segment electrode 26 (FIG. 3) combined with the 170 volts which have remained on the column electrode 28 due to the capacitive action of the cell 20 in a manner that is well-known in the art results in the cell 20 reaching a voltage level at which a gaseous discharge occurs. The igniting of the cell 20 and the subsequent discharge causes a wall charge to be deposited on the inside glass surface walls of the cell 20. The wall charge produces a wall voltage opposite in polarity to that of the applied voltage which initially drove the cell 20 into ignition. Assuming, for purposes of illustration, that the wall charge in the cell 20 contributes a voltage of 170 volts, it is seen that the cell voltage drops to 170 volts after ignition, since the wall voltage $V_W$ is negative with respect to the applied voltage $V_a$. The transistors 40 and 52 are subsequently switched back into a conductive state to again impress 85 volts at the electrode 26. Upon this occurrence, the voltage across the cell 20 is again sufficiently high to drive the cell into ignition. The above operation is repeated so long as the transistors 40 and 52, together with the transistor 44 are alternately pulsed into conduction. The present invention provides a high voltage supply for the transistors 40, 44, and 52 by providing a flyback transformer which supplies the 85 and 170 volts required to fire the cell 20 at a high frequency rate which is equal to the system clock in a manner to be described more fully hereinafter.

Figure 4:
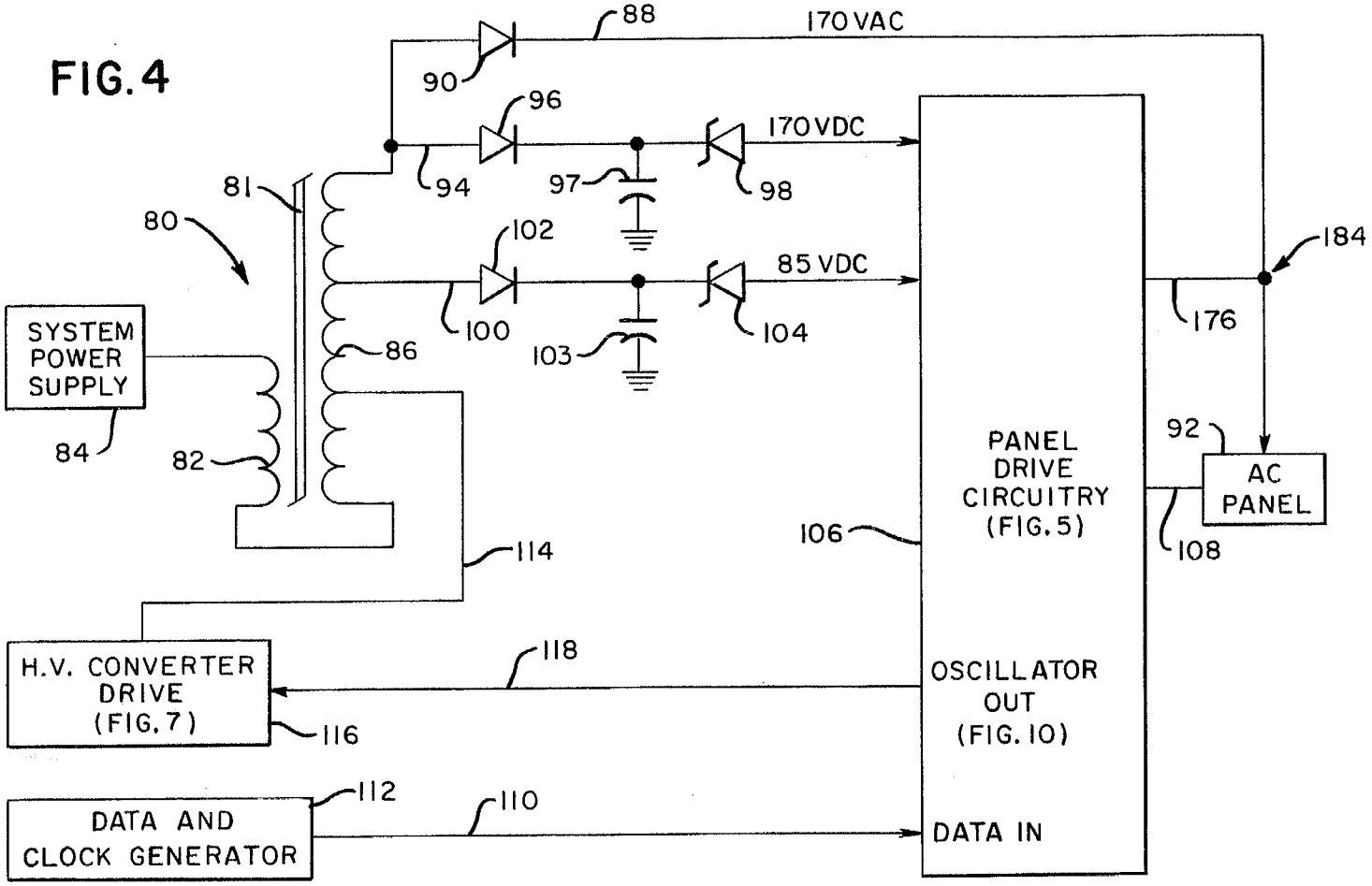
FIG. 4 is a schematic diagram of the gas-discharge display drive circuit of the present invention.

Referring now to FIG. 4, there is shown a schematic diagram of the gas discharge display drive circuit of the present invention which includes a flyback transformer generally indicated by the numeral 80 and which includes primary windings 82 coupled to the system power supply 84 and secondary windings 86 which are tapped over line 88 to output 170 volts AC through diode 90 to the column electrodes 28 (FIG. 3) in the gas-discharge display panel 92, over line 94 to output 170 volts DC through diodes 96 and 98 and over line 100 to output 85 volts DC through diodes 102 and 104, the 85 and 100 DC voltage pulses being transmitted to the panel drive circuit 106 which selectively supplies the 85 volt pulses to the segment electrodes 26 (FIG. 3) over bus 108 comprising the segment electrode conductors in accordance with the data signals transmitted over bus 110 from a data generator 112. The secondary windings 86 of the transformer 80 are also coupled over line 114 to a high voltage converter drive circuit 116 which is driven by timing signals transmitted from the panel drive circuitry 106 over line 118. The high voltage converter drive circuitry 116 controls the operation of the transformer 80 to enable the secondary windings 86 to supply the required voltage pulses to the display panel 92 and the panel drive circuitry 106 in a manner that will be described more fully hereinafter.

Figure 5B:
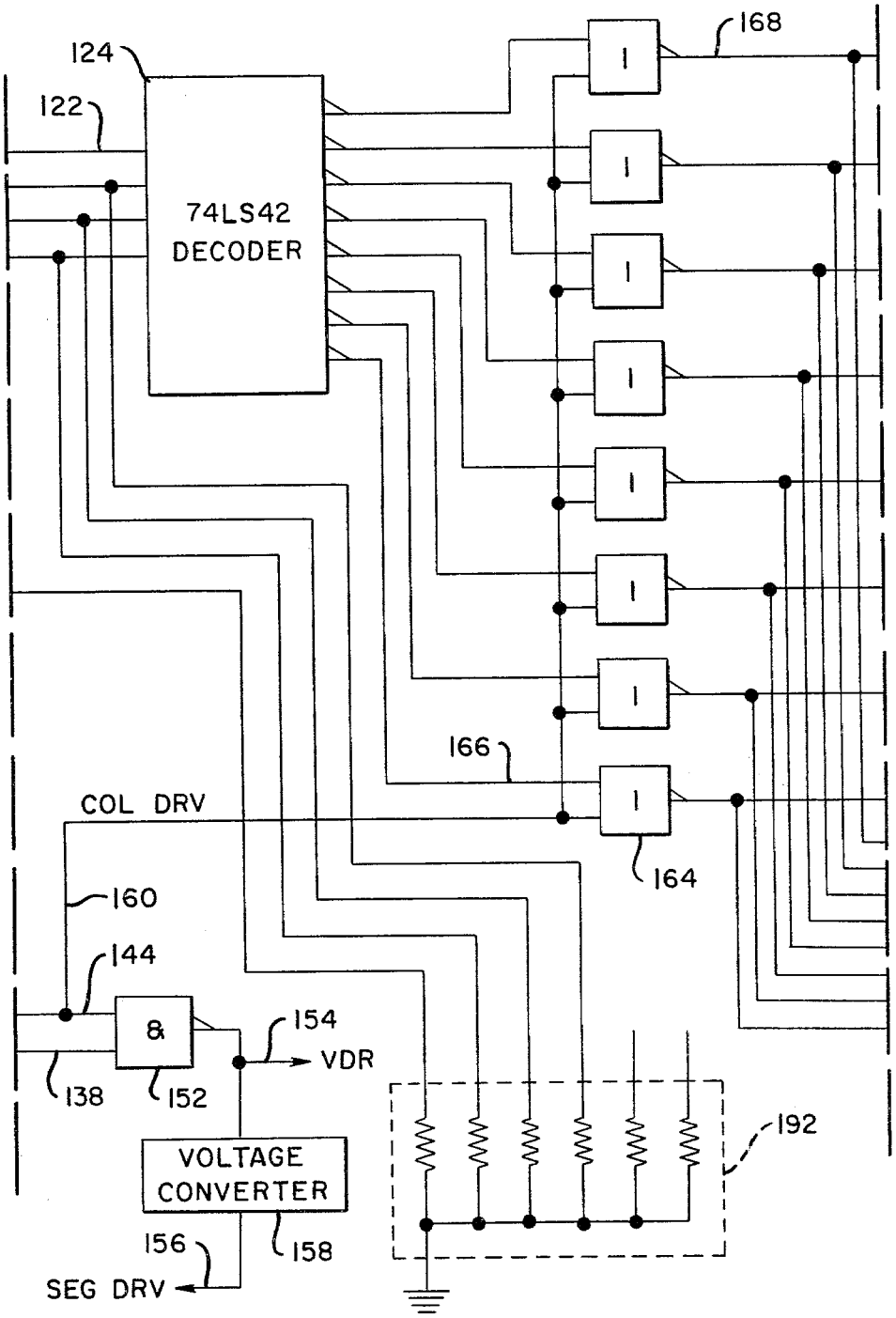
Figure 5C:
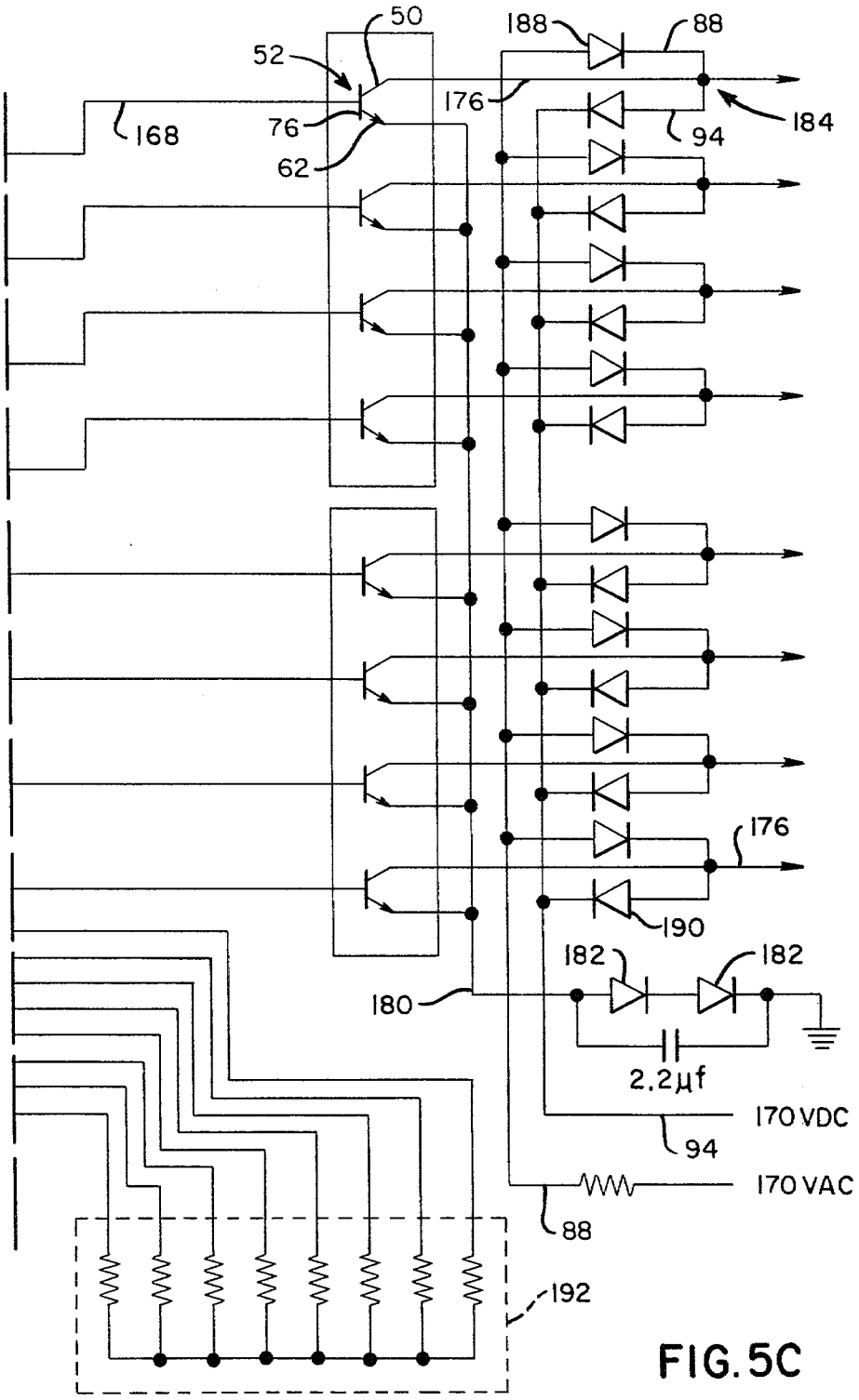
Figure 10:
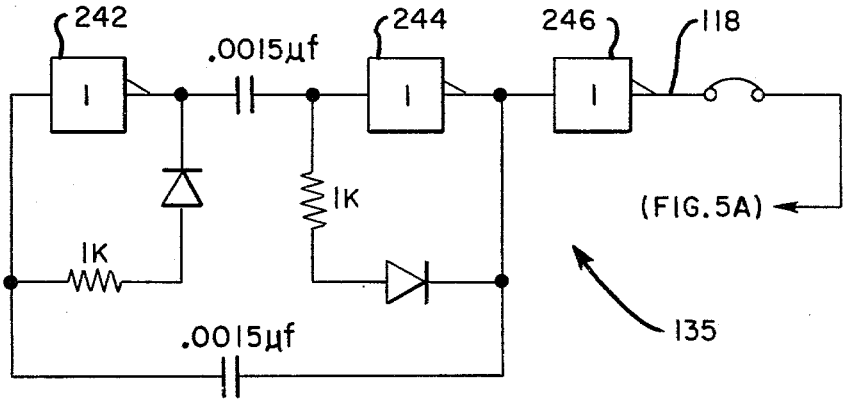
FIG. 10 is a schematic diagram of the oscillator circuit employed in the driver circuits of the present invention.

Referring now to FIGS. 5A–5C inclusive arranged in the manner shown in FIG. 6, there is disclosed the drive circuits for the column electrodes 28 (FIG. 3) in the gas-discharge panel 92. Included in the circuit is a dual flip-flop 120 (FIG. 5A) which over lines 110*e* and 110*f* receives appropriate clock signals from the data and clock generator 112 (FIG. 4) and the system oscillator 135 (FIG. 10) over line 118. The flip-flop 120 is commercially available from the Motorola Semiconductor Products Inc. of Phoenix, Ar. as part no. 74LS74. Unless otherwise stated, all I.C. elements designated hereinafter are commercially available from the Motorola Semiconductor Products Inc.

Figure 9:
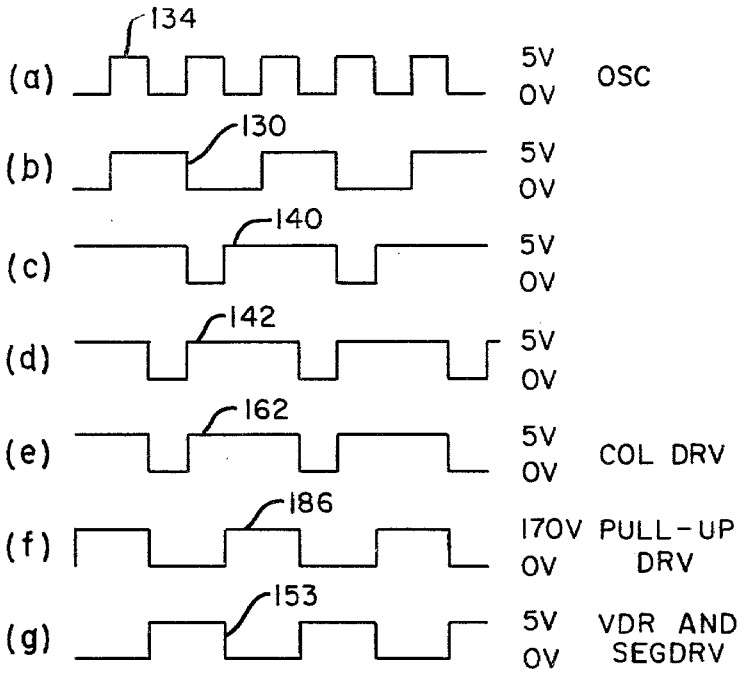
FIG. 9 shows a plurality of waveforms used in the operation of the circuits shown in FIGS. 5A–5C inclusive and FIGS. 7A and 7B inclusive.

The flip-flop 120 will output over line 122 a blanking pulse to a 74LS42 decoder 124 (FIG. 5B), an inverted blanking pulse over line 126 to one input of a NAND gate 128 and a clocking pulse 130 (FIG. 9*b*) over line 132 which has a rate of one-half the frequency of the clock pulses 134 (FIG. 9*a*) received from the system oscillator 135 (FIG. 10) over line 118. The clock pulses 130 appearing on line 132 are inputted into a 74LS42 decoder 136 which also receives over line 118 the clock pulses 134 (FIG. 9*a*) from the system oscillator 135 (FIG. 10) and which are generated at a rate of 85 KHz. in a manner to be described more fully hereinafter. The decoder 136 outputs over line 138 the clock pulses 140 (FIG. 9*c*) and the clock pulses 142 (FIG. 9*d*) over line 144 in response to receiving the clock pulses 134 over line 118 and the clock pulses 130 over line 132. The decoder 136 is disabled upon receiving a control pulse over line 146 from the gate 128 as a result of the active low blanking pulse transmitted over line 126 from the flip-flop 120 and a display clear signal transmitted from the generator 112 (FIG. 4) over lines 110*d*, 148 and through an inverter 150 to one input of the gate 128.

The clock pulses 140 and 142 (FIG. 9) outputted by the decoder 136 are inputted to a NAND gate 152 (FIG. 5B) which outputs the segment drive (SEG DRV) and voltage drive (VDR) pulses 153 (FIG. 9*g*) over lines 154 and line 156 respectively. The SEG DRV pulse 153 is pulled up to a 12 volt level by the 74LS35 voltage converter or buffer 158 (FIG. 5B). As will be described more fully hereinafter, the signals VDR are used to control the operation of the transformer 80 (FIG. 4). The pulse 142 (FIG. 9*d*) appearing on the output line 144 of the decoder 136 (FIG. 5A) and transmitted over line 160 as the column drive signal (COL DRV) 162 (FIG. 9*e*) are inputted into one input of a plurality of NOR gates 164 whose other input is connected over line 166 to the output of the decoder 124. Column sheet data signals appearing on lines 110*a*–110*c* inclusive and transmitted from the data generator 112 (FIG. 4) select which of the column electrodes 28 (FIG. 3) in the panel 92 (FIG. 4) are to be energized. The column select signals are inputted into the decoder 124 (FIG. 5B) which outputs an active low control pulse over one of the output lines 166 in accordance with the column select data signals received in a manner that is well-known in the art. The active low control pulse appearing on the output line 166 is inverted by the corresponding NOR gate 164 and transmitted over line 168 to the base electrode 76 of the NPN transistor 52 (FIGS. 3 and 5C). The collector electrode 50 of each of the transistors 52 is connected over line 176 to one of the column electrodes 28 (FIG. 3) in the panel 92 (FIG. 4) while the emitter electrode 62 is connected over line 180 to ground through the voltage control diodes 182. The line 176 is connected at point 184 (FIGS. 4 and 5*c*) to a 170 volt DC voltage source over line 94 (FIG. 4) through isolation diode 190, thereby clamping the point 184 at 170 volts. The point 184 is also connected to a 170 volt AC voltage source over line 88 over which the 170 AC pull-up drive pulses 186 (FIG. 9*f*) are transmitted through the diode 188 (FIG. 5C) to charge each of the column electrodes in the display panel 92 (FIG. 4) to 170 volts. As will be described more fully hereinafter, energizing of one of the transistors 52 (FIGS. 4 and 5C) by the signals appearing on line 168 (FIGS. 5B and 5C) will ground the selected column electrode enabling the selected cells 32*a*–32*g* (FIG. 2) connected to the grounded column electrode to be fired. Included in the circuits of FIGS. 5B and 5C are line terminators generally indicated by the numeral 192 which reduces the effect of noise in the circuits.

Figure 7A:
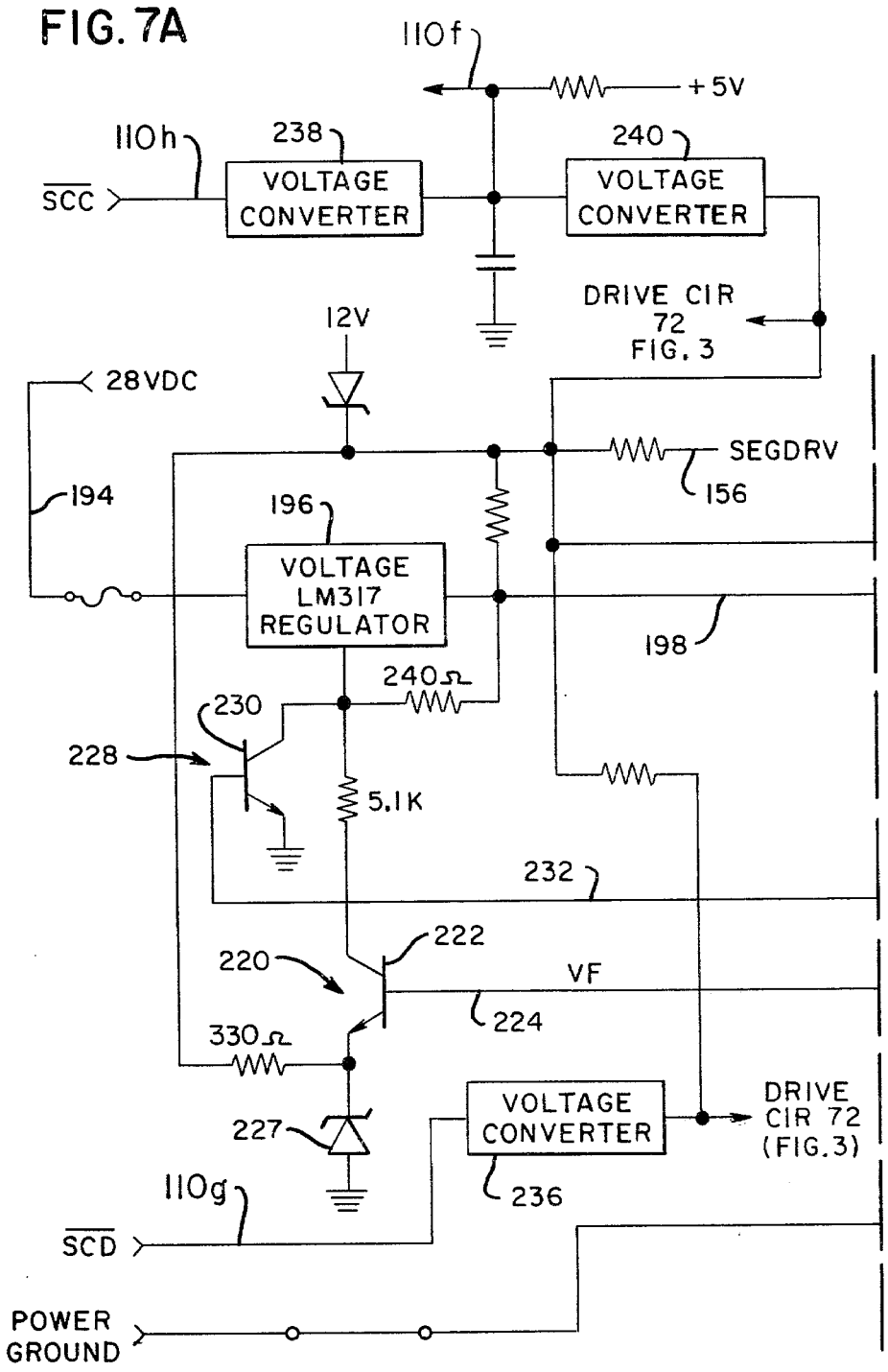
FIGS. 7A and 7B inclusive taken together are a schematic diagram of the high voltage drive portion of the display driver circuits for energizing a cell in accordance with the present invention.
Figure 7B:
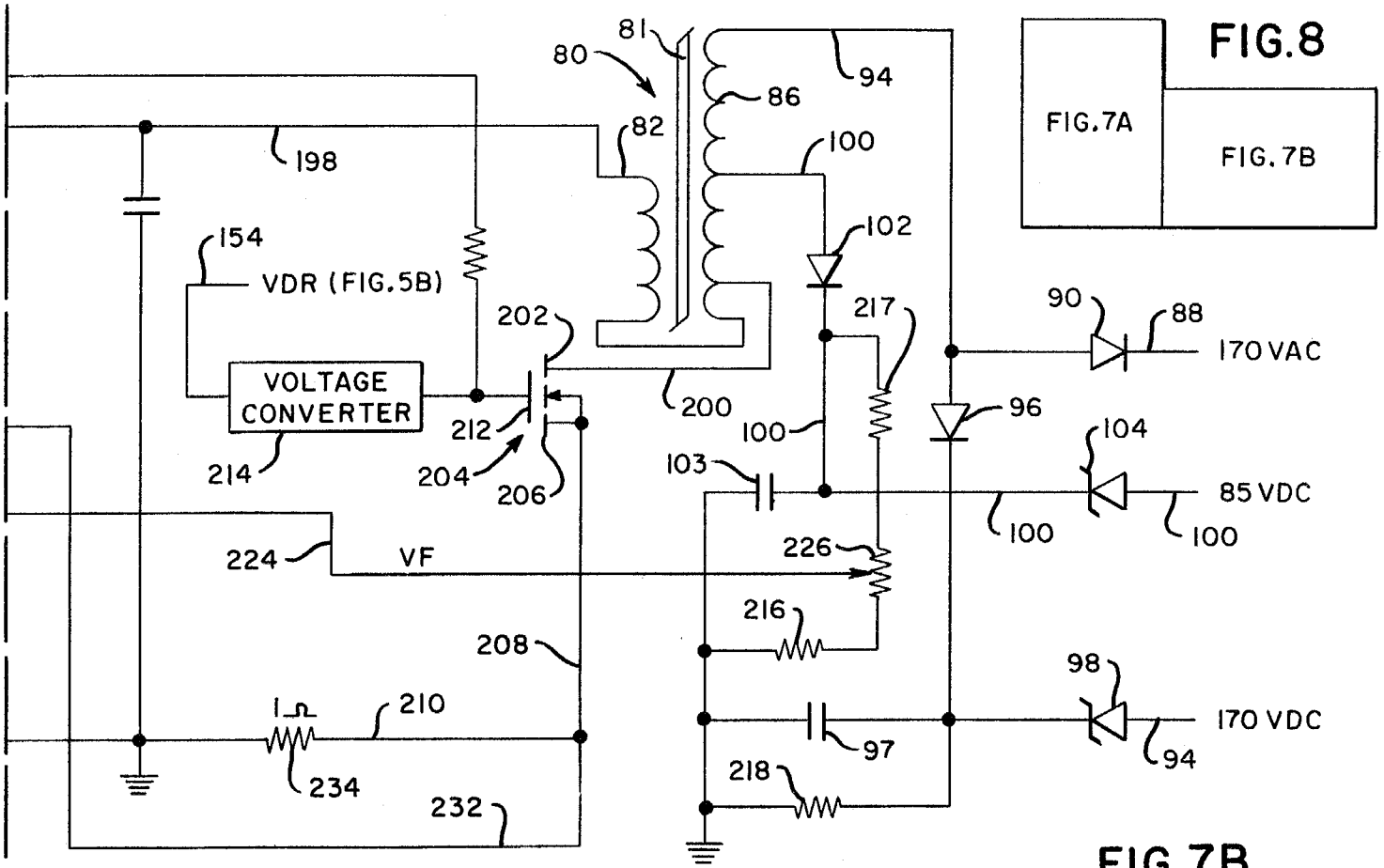

Referring now to FIGS. 7A and 7B arranged in the manner shown in FIG. 8, there is shown a circuit for controlling the operation of the transformer 80 (FIG. 4). Included in the circuit is a transmission line 194 (FIG. 7A) over which is transmitted a DC voltage from the system power supply 84 (FIG. 4) having a voltage level of 28 volts, which voltage is transmitted through an LM317 voltage regulator 196 and over line 198 to the primary winding 82 of the transformer 80. The transformer may be an auto-transformer of the type commercially available from the Coil Craft Company of Cary, Ill., as part no. B8690. In a manner that is well-known in the art, the current will flow through the primary windings 82 generating a magnetic flux around a ferrite core 81 and to the secondary windings 86 which is tapped over line 200 to the drain electrode 202 of a FET transistor indicated generally by the numeral 204 and which is commercially available from Siliconics Corporation of Santa Barbara, Calif., as part no. VN88AF. The source electrode 206 of transistor 204 is grounded through lines 208 and 210 while the base electrode 212 is connected through a LS7435 voltage converter 214 to line 154 (FIGS. 5B and 7B) over which appears the voltage drive signal VDR 153 (FIG. 9*g*).

The transformer 80 is also tapped over line 94 over which is generated by transformer operation a series of voltage pulses having a level of 170 volts AC. The pulses are transmitted through the diode 90 and over line 88 to the column conductors 176 (FIG. 5C) for charging the column electrodes 26 (FIG. 3) to a voltage level of 170 volts. The transformer 80 is center tapped over line 100 to output voltage pulses having a voltage level of 85 volts DC. These voltage pulses are transmitted through the diodes 102 and 104 and over line 100 to the segment electrodes 26 (FIG. 3) in a manner to be described more fully hereinafter. The zener diode 104 is used to set the operating voltage of the display 92 (FIG. 4) in a manner that is well-known in the art. The 170 volt AC voltage pulses appearing on line 94 are transmitted through diodes 96 and 98 to clamp the point 184 (FIG. 5C) at 170 volts in the manner described previously. Included in the circuit of FIG. 7B are filter capacitors 97 and 103 for generating the DC voltage by removing the ripple in the AC pulses appearing on lines 94 and 100 together with the load resistor 218.

In order to provide a uniform voltage level of the pulses applied to the column electrodes 28 (FIG. 3) and the segment electrodes 26 as the load on the power supply 84 (FIG. 4) varies, a voltage regulator circuit is employed to regulate the 28 volts DC voltage supply 84 (FIG. 4), which circuit includes an NPN 2N3904 transistor 220 (FIG. 7A) whose base electrode 222 is connected over line 224 to a voltage divider circuit comprising the load resistors 216, 226 and 217 (FIG. 7B) which outputs a feedback signal VF whose voltage level is proportional to the voltage level appearing on the secondary windings 86 of the transformer 80 and which is compared with a reference voltage level appearing at the cathode of the zener diode 227 (FIG. 7A). As the load on the power supply 84 (FIG. 4) varies due to the change in the number of cells being fired, the feedback signal VF will exceed the reference voltage turning on the transistor 220 which varies the current level in the regulator 196 resulting in a variation of the voltage level of the pulse being applied to the primary windings 82 of the transformer 80. Thus, when the voltage level in the secondary windings 86 of the transformer 80 becomes too high, the input voltage level applied to the primary windings 82 is reduced.

There is also included in FIGS. 7A and 7B an overcurrent protection circuit for the FET transistor 204 (FIG. 7B), which circuit includes an NPN 2N3904 transistor 228 (FIG. 7A) whose base electrode 230 is connected over lines 232 and 208 to the source electrode 206 of the transistor 204. Upon the current flow in the transistor 204 reaching a predetermined level, the voltage drop across the resistor 234 (FIG. 7B) will allow the transistor 228 to conduct, thereby grounding the regulator 196 and disabling the DC voltage supply to the primary winding 82 of the transformer 80.

The segment select signals $\overline{SCD}$ are transmitted from the data generator 112 (FIG. 4) over lines 110*g* (FIG. 7A) and through the voltage converter 236 which raises the voltage level of the signals to 12 volts. In a similar manner, the data clock signals $\overline{SCC}$ appearing on line 110*h* (FIG. 7A) and transmitted from the data generator 112 (FIG. 4) are raised to a 12 volt signal level by the 75701 converters 238 and 240 which signals, together with the segment select signals $\overline{SCD}$, are transmitted to the driver circuits 68 and 72 (FIG. 3) for enabling the selected segments to be fired. The oscillator circuit generally indicated by the numeral 135 in FIG. 10 includes three 7407 inverters 242, 244 and 246 which, together with the values of the RC circuits shown, will output over line 118 clock pulses having a frequency of 85 KHz. in a manner that is well-known in the art.

In the operation of the gas discharge display panel 92 (FIG. 4), a plurality of binary signals representing a column electrode to be energized will be transmitted over lines 110*a*–110*c* inclusive (FIG. 5A) to the decoder 124 (FIG. 5B) which has been enabled by a blanking pulse appearing on the output line 122 of the flip-flop 120 (FIG. 5A). Prior to this, the decoder 136 (FIG. 5A), in response to receiving the clock pulses 130 (FIG. 9*b*) over line 132 from the flip-flop 120 and the 85 KHz. clock pulses 134 (FIG. 9*a*) transmitted over line 118, will output the column drive pulses 162 (FIG. 9*e*) over line 160 to the NOR gates 164 (FIG. 5B) and to the NAND gate 152 which outputs the segment drive and VDR pulses 153 (FIG. 9*g*). The VDR pulses 153 are transmitted to the FET transistor 204 (FIG. 7B) which, upon the occurrence of the rising edge of the pulse 153, will forward bias the transistor 204 enabling the transistor to conduct, thereby grounding the primary windings 82 of the transformer 80 and allowing the regulated voltage appearing on line 198 to flow through the primary windings 82. Upon the trailing edge of the pulse 153 returning to zero, the transistor 204 is reversed biased disabling the transistor and removing the ground from the primary windings 82 of the transformer. When this occurs, the flux built up in the ferrite core 81 of the transformer 80 will collapse across the secondary windings 86 resulting in 170 volts AC signals appearing in line 94 which are rectified by the diode 96 to produce the pull-up drive pulses 186 (FIG. 9*f*). These pulses are transmitted over lines 88 and 176 (FIG. 5C) to the column electrodes 28 (FIG. 3) charging the electrodes to 170 volts DC. During this operation, the segment drive pulses 153 (FIG. 9*g*) which are 180 degrees out of phase with the pull-up drive pulses 186 (FIG. 9*f*) are transmitted to the transistors 44 (FIG. 3) whose operation grounds the segments 32 and allows the column electrodes 28 (FIG. 3) to be charged to 170 volts DC.

After the column electrodes 28 have been charged to 170 volts DC, the column drive pulses 162 (FIG. 9*e*) enable the NOR gates 164 (FIG. 5B) to output an active high column select signal which had appeared as an active low signal on one of the output lines 166 of the decoder 124 (FIG. 5B). This active high signal which occurs when the pulse 162 goes low is transmitted to the base electrode of one of the transistors 52 (FIG. 5C) enabling the transistor 52 to ground the selected column electrodes over lines 176 and 180 and removing the 170 volt charge on the selected electrodes. Due to the capacitive construction of the cell 20 (FIG. 1), the 170 volts on the grounded column electrodes will remain. At this time, the segment drive pulse 153 (FIG. 9*g*) will go high enabling the transistors 40 (FIG. 3) associated with the segments 32*a*–32*g* (FIG. 2) selected to be fired by the segment select signals appearing on lines 110*g* (FIG. 7A) to be operated resulting in the 85 volts DC appearing on line 108 (FIG. 4) to charge the selected segments to a voltage level of 85 volts. This voltage level combined with the 170 volts appearing on the selected column electrodes results in the firing of the selected segments 32*a*–32*g* having a total voltage drop across the segment cell 20 of 255 volts. Those segments which were not selected remain at ground. Upon the column drive pulse 162 (FIG. 9*e*) returning to a high level, the high pulse being applied to the selected transistors 52 (FIG. 5C) is removed allowing the voltage level of the column electrode to float until the VDR pulse 153 (FIG. 9*g*) goes high initiating another operation of the transformer 80. The use of the flyback operation of the transformer 80 at the high frequency rate of the system oscillator provides the required voltage drive levels to both the column and segment electrodes at a relatively low cost.

While the invention has been described in its preferred embodiment, it is to be understood that the words which have been used are words of description rather than limitation and that changes may be made within the purview of the appended claims without departing from the true scope and spirit of the invention in its broader aspect.

We claim:

1. Apparatus for driving a gas-discharge device of the type having an array of cells in which each cell has a column electrode and a segment electrode comprising in combination:

a plurality of column conductors each connected to one of said column electrodes;

a plurality of segment conductors each connected to one of said segment electrodes forming a matrix with said plurality of column conductors;

a low level direct current voltage source;

a single multi-tap secondary, high voltage autotransformer having primary windings coupled to said voltage source and center tapped secondary windings having one end connected directly to said column electrodes for supplying a high level alternating voltage pulse to said column electrodes which level is insufficient to discharge the electrode, said secondary windings further having a center tapped portion connected directly to said segment electrode for supplying a low level alternating voltage pulse to said segment electrodes whose level is insufficient to discharge the electrodes, said high and low level voltage pulses being generated in response to the primary windings being alternately enabled and disabled in response to receiving alternating pulses from said voltage source;

means connected to said low level direct current voltage source and said secondary windings for varying the output level of the voltage source in accordance with the number of cells being discharged;

a source of high frequency system clock pulses;

first switching means connected to said source of clock pulses, said low voltage direct current voltage source and said primary windings for outputting a plurality of alternating voltage pulses to said primary windings in response to receiving said clock pulses;

a plurality of second switching means each connected to one of said column conductors and to ground, each of said second switching means adapted to ground its associated column conductor to remove the high level alternating voltage pulses from its associated column electrodes when enabled;

a plurality of third switching means connected to said segment conductors and said source of clock pulses, said third switching means operated by the clock pulses for supplying said low voltage alternating pulses to said segment conductors which is out of phase with the supply of said high level alternating voltage pulses supplied to said column conductors by the secondary windings of the autotransformer;

and control means connected to said column and segment conductors and said source of clock pulses for generating control signals over said conductors to enable selected column and segment electrodes to be discharged in response to receiving said high and low level alternating voltage pulses respectively.

2. The apparatus of claim 1 in which said control means includes:

data generator means for generating column select signals and segment select control signals;

and first logic means connected to said source of clock pulses and said data generator means and enabled by said clock pulses and said column select control signals to operate said second switching means, thereby removing the high level voltage pulses from the selected column electrodes in the cells to be discharged.

3. The apparatus of claim 2 in which said source of clock pulses includes oscillator means for outputting a plurality of system clock pulses at a fixed frequency, said source of clock pulses further including second logic means coupled to said oscillator means and said data generator means for outputting said clock pulses in response to receiving said system clock pulses and said column select clock pulses.

4. The apparatus of claim 3 in which said varying means includes voltage regulator means connected to said voltage source and said secondary windings of said autotransformer for controlling the voltage level supplied to the primary windings of said autotransformer in accordance with the voltage level developed in the secondary windings.

5. The apparatus of claim 3 in which the frequency of the system clock pulses in 85 KHz.

6. In a system for driving a gas-discharge device of the type having an array of cells in which each cell has a common electrode and a segment electrode each of which receives opposite phase alternating drive pulses, the improvement comprising:

a plurality of column conductors each connected to one of said column electrodes;

a plurality of segment conductors each connected to one of said segment electrodes and forming a matrix with said plurality of column conductors;

a low level direct current voltage source;

a single multi-tap secondary, high voltage autotransformer having primary windings connected to said voltage source and center tapped secondary windings having one end connected directly to said column conductors for supplying a high level alternating voltage pulse to said column electrodes whose level is insufficient to discharge the electrodes, said secondary windings further having a center tapped portion connected directly to said segment conductors for supplying a low level alternating voltage pulse to said segment electrodes whose level is insufficient to discharge the electrode, said high and low level voltage pulses being generated in response to the alternate enabling and disabling of said primary windings;

a source of high-frequency system clock pulses;

means connected to said secondary windings and said voltage source for varying the output signal level of the voltage source in accordance with the number of cells discharged;

first switching means connected to said source of high frequency clock pulses and said primary windings for cyclically enabling and disabling the application of a voltage pulse from said voltage source to said primary windings in accordance with the frequency of said clock pulses;

data and clock generating means for supplying column and segment control signals to said column and segment conductors for selecting the cell to be discharged;

a plurality of second switching means each connected to one of said column conductors and to ground for enabling a column electrode to be discharged when operated;

a plurality of third switching means connected to said segment conductors and said source of high frequency clock pulses, said third switching means operated by said high frequency clock pulses to supply said low level alternating voltage pulses to said segment conductors which is out of phase with said high level alternating voltage pulses supplied to said column conductors by the secondary windings of the autotransformer;

and first logic circuit means connected to said data and clock generating means and said high frequency clock generating means for operating selected second switching means in accordance with the column select signals generated enabling the selected column electrodes to be discharged.

7. The system of claim 6 in which said varying means includes a current regulator circuit connected to said voltage source and the primary and secondary windings of said autotransformer for varying the voltage level supplied to the primary windings of said autotransformer in accordance with the voltage level developed in the secondary windings.

8. The system of claim 6 in which said first switching means comprises a FET transistor having a grounded source electrode and whose base electrode is connected to said high-frequency clock generating means, said transistor further having its drain electrode connected to the primary windings of the autotransformer for enabling said voltage source to be cyclically applied to the primary windings in accordance with the frequency of the clock pulses received from said clock generating means.

9. The system of claim 8 in which said high frequency clock generating means includes:

oscillator means for generating a plurality of clock pulses;

and second logic means coupled to said oscillator means and said data and clock generator means for outputting to the base electrode of the FET transistor and said first logic means clock pulses for enabling selected column electrodes to be discharged.

10. The system of claim 9 in which the frequency of said high-frequency clock generating means is 85 KHz.

11. The system of claim 10 in which said current regulator circuit includes:

a current sensitive voltage regulator device coupled to said voltage source and said primary windings;

a transistor coupled to said voltage regulator device and ground;

and a voltage sensing circuit connected to said transistor and the secondary windings of the autotransforming for operating said transistor in response to a change in the level of the voltage developed in said secondary windings whereby said voltage regulator device varies the voltage level supplied to said primary windings which is inversely proportional to the change in the voltage level in the secondary windings.

* * * * *